US007119774B2

(12) United States Patent
Willis et al.

(10) Patent No.: US 7,119,774 B2
(45) Date of Patent: Oct. 10, 2006

(54) REDUCING SPARKLE ARTIFACTS WITH LOW BRIGHTNESS FILTERING

(75) Inventors: Donald Henry Willis, Indianapolis, IN (US); John Alan Hague, Indianapolis, IN (US)

(73) Assignee: Thomson Licensing, Boulogne-Billancourt (FR)

( * ) Notice: Subject to any disclaimer, the term of this patent is extended or adjusted under 35 U.S.C. 154(b) by 444 days.

(21) Appl. No.: 09/803,485

(22) Filed: Mar. 9, 2001

(65) Prior Publication Data

US 2002/0126134 A1 Sep. 12, 2002

(51) Int. Cl.
*G09G 3/36* (2006.01)

(52) U.S. Cl. ..... 345/89; 345/87; 345/88; 345/98; 345/204

(58) Field of Classification Search ..... 345/50, 345/54–55, 84, 87–88, 85, 96, 98, 204, 89
See application file for complete search history.

(56) References Cited

U.S. PATENT DOCUMENTS

| | | | | | |
|---|---|---|---|---|---|
| 4,499,497 | A * | 2/1985 | Levine | 348/300 |
| 4,523,230 | A * | 6/1985 | Carlson et al. | 348/623 |
| 4,799,105 | A | 1/1989 | Mitchell et al. | 358/160 |
| 4,855,831 | A | 8/1989 | Miyamoto et al. | 358/183 |
| 5,019,904 | A | 5/1991 | Campbell | 358/140 |
| 5,247,169 | A * | 9/1993 | Okada et al. | 250/226 |
| 5,361,094 | A * | 11/1994 | Jang | 348/254 |
| 5,442,407 | A * | 8/1995 | Iu | 348/620 |
| 5,589,880 | A * | 12/1996 | Tsukui | 348/229.1 |
| 5,936,621 | A | 8/1999 | Medin et al. | 345/213 |
| 5,978,047 | A * | 11/1999 | May | 348/616 |
| 6,181,368 | B1 * | 1/2001 | Takahashi et al. | 348/65 |
| 6,219,101 | B1 | 4/2001 | Sani et al. | 348/447 |
| 6,347,161 | B1 | 2/2002 | Mancuso | 382/261 |
| 6,359,663 | B1 * | 3/2002 | Gadeyne et al. | 348/790 |
| 6,429,904 | B1 | 8/2002 | Sani et al. | 348/572 |
| 6,734,850 | B1 * | 5/2004 | Deering | 345/419 |

FOREIGN PATENT DOCUMENTS

JP 08-088770 * 2/1996

* cited by examiner

*Primary Examiner*—Richard Hjerpe
*Assistant Examiner*—Leonid Shapiro
(74) *Attorney, Agent, or Firm*—Joseph J. Laks; Harvey D. Fried; Christine Johnson

(57) ABSTRACT

A video signal is decomposed into a higher brightness level signal and a lower brightness level signal. The threshold between higher and lower brightness levels is adjustable and related to the transition between lower and higher gain portions of the gamma table for an associated liquid crystal imager. The lower brightness level signal is low pass filtered to reduce the difference in brightness between adjacent pixels. The higher brightness level signal is delayed in time to match the processing delay through the low pass filter. The delay matched signal and the low pass filtered signal are combined to form a modified video signal less likely to result in sparkle artifacts in the imager. Sparkle reduction processing can be applied to luminance signals and to video drive signals in various combinations, based on independently selectable thresholds.

25 Claims, 3 Drawing Sheets

REDUCING SPARKLE ARTIFACTS WITH LOW BRIGHTNESS FILTERING

BACKGROUND OF THE INVENTION

1. Field of the Invention

This invention relates to the field of video systems utilizing a liquid crystal display (LCD), and in particular, to video systems utilizing normally white liquid crystal on silicon imagers.

2. Description of Related Art

Liquid crystal on silicon (LCOS) can be thought of as one large liquid crystal formed on a silicon wafer. The silicon wafer is divided into an incremental array of tiny plate electrodes. A tiny incremental region of the liquid crystal is influenced by the electric field generated by each tiny plate and the common plate. Each such tiny plate and corresponding liquid crystal region are together referred to as a cell of the imager. Each cell corresponds to an individually controllable pixel. A common plate electrode is disposed on the other side of the liquid crystal. Each cell, or pixel, remains lighted with the same intensity until the input signal is changed, thus acting as a sample and hold. The pixel does not decay, as is the case with the phosphors in a cathode ray tube. Each set of common and variable plate electrodes forms an imager. One imager is provided for each color, in this case, one imager each for red, green and blue.

It is typical to drive the imager of an LCOS display with a frame-doubled signal to avoid 30 Hz flicker, by sending first a normal frame (positive picture) and then an inverted frame (negative picture) in response to a given input picture. The generation of positive and negative pictures ensures that each pixel will be written with a positive electric field followed by a negative electric field. The resulting drive field has a zero DC component, which is necessary to avoid the image sticking, and ultimately, permanent degradation of the imager. It has been determined that the human eye responds to the average value of the brightness of the pixels produced by these positive and negative pictures.

The drive voltages are supplied to plate electrodes on each side of the LCOS array. In the presently preferred LCOS system to which the inventive arrangements pertain, the common plate is always at a potential of about 8 volts. This voltage can be adjustable. Each of the other plates in the array of tiny plates is operated in two voltage ranges. For positive pictures, the voltage varies between 0 volts and 8 volts. For negative pictures the voltage varies between 8 volts and 16 volts.

The light supplied to the imager, and therefore supplied to each cell of the imager, is field polarized. Each liquid crystal cell rotates the polarization of the input light responsive to the root mean square (RMS) value of the electric field applied to the cell by the plate electrodes. Generally speaking, the cells are not responsive to the polarity (positive or negative) of the applied electric field. Rather, the brightness of each pixel's cell is generally only a function of the rotation of the polarization of the light incident on the cell. As a practical matter, however, it has been found that the brightness can vary somewhat between the positive and negative field polarities for the same polarization rotation of the light. Such variation of the brightness can cause an undesirable flicker in the displayed picture.

In this embodiment, in the case of either positive or negative pictures, as the field driving the cells approaches a zero electric field strength, corresponding to 8 volts, the closer each cell comes to white, corresponding to a full on condition. Other systems are possible, for example where the common voltage is set to 0 volts. It will be appreciated that the inventive arrangements taught herein are applicable to all such positive and negative field LCOS imager driving systems.

Pictures are defined as positive pictures when the variable voltage applied to the tiny plate electrodes is less than the voltage applied to the common plate electrode, because the higher the tiny plate electrode voltage, the brighter the pixels. Conversely, pictures are defined as negative pictures when the variable voltage applied to the tiny plate electrodes is greater than the voltage applied to the common plate electrode, because the higher the tiny plate electrode voltage, the darker the pixels. The designations of pictures as positive or negative should not be confused with terms used to distinguish field types in interlaced video formats.

The present state of the art in LCOS requires the adjustment of the common-mode electrode voltage, denoted VITO, to be precisely between the positive and negative field drive for the LCOS. The subscript ITO refers to the material indium tin oxide. The average balance is necessary in order to minimize flicker, as well as to prevent a phenomenon known as image sticking.

A light engine having an LCOS imager has a severe non-linearity in the display transfer function, which can be corrected by a digital lookup table, referred to as a gamma table. The gamma table corrects for the differences in gain in the transfer function. Notwithstanding this correction, the strong non-linearity of the LCOS imaging transfer function for a normally white LCOS imager means that dark areas have a very low light-versus-voltage gain. Thus, at lowet brightness levels, adjacent pixels that are only moderately different in brightness need to be driven by very different voltage levels. This produces a fringing electrical field having a component orthogonal to the desired field. This orthogonal field produces a brighter than desired pixel, which in turn can produce undesired bright edges on objects. The presence of such orthogonal fields is denoted disclination. The image artifact caused by disclination and perceived by the viewer is denoted sparkle. The areas of the picture in which disclination occurs appear to have sparkles of light over the underlying image. In effect, dark pixels affected by disclination are too bright, often five times as bright as they should be. Sparkle comes in red, green and blue colors, for each color produced by the imagers. However, the green sparkle is the most evident when the problem occurs. Accordingly, the image artifact caused by disclination-is also referred to as the green sparkle problem.

LCOS imaging is new technology and green sparkle caused by disclination is a new kind of problem. Various proposed solutions by others include signal processing the entire luminance component of the picture, and in so doing, degrade the quality of the entire picture. The trade-off for reducing disclination and the resulting sparkle is a picture with virtually no horizontal sharpness at all. Picture detail and sharpness simply cannot be sacrificed in that fashion.

One skilled in the art would expect the sparkle artifact problem attributed to disclination to be addressed and ultimately solved in the imager as that is where the disclination occurs. However, in an emerging technology such as LCOS, there simply isnt't an opportunity for parties other than the manufacturer of the LCOS imagers to fix the problem in the imagers. Moreover, there is no indication that an imager-based solution would be applicable to all LCOS imagers. Accordingly, there is an urgent need to provide a solution to this problem that can be implemented without modifying the LCOS imagers.

BRIEF SUMMARY OF THE INVENTION

The inventive arrangements taught herein solve the problem of sparkle in liquid crystal imagers attributed to disclination without degrading the high definition sharpness of the resulting display. Moreover, and absent an opportunity to address the problem by modification of imagers, the inventive arrangements advantageously solve the sparkle problem by modifying the video signal to be displayed, thus advantageously presenting a solution that can be applied to all liquid crystal imagers, including LCOS imagers. Any reduction in detail is advantageously and adjustably limited to dark scenes, even very dark scenes. The video signal is signal processed in such a way that higher brightness level information is advantageously unchanged, thus retaining high definition detail. At the same time, the lower brightness levels of the video signal that directly result in sparkle are processed in such a way that the sparkle is advantageously prevented altogether, or at least, is reduced to a level that cannot be perceived by a viewer. The signal processing of the lower brightness level information advantageously does not unacceptably degrade the detail of the high definition display. Moreover, signal processing in the form of slew rate limiting can advantageously be adjusted or calibrated in accordance with the non-linear gain of any gamma cable, and thus, can be used with and adjustably fine tuned for different imagers in different video systems.

In a presently preferred embodiment, the video signal of a picture is decomposed into a higher brightness level signal and a lower brightness level signal. The demarcation between higher and lower brightness levels is adjustable and preferably related to the transition between the lower and higher gain portions of the gamma table. The lower brightness level signal is low pass filtered to reduce the difference in brightness levels between adjacent pixels. The higher brightness level signal is delayed in time to match the processing delay through the low pass filter. The delay matched higher brightness level signal and the low pass filtered lower brightness level signal are then combined to form a modified video signal.

In a video display system the luminance signal can be modified and supplied to a color space converter, also referred to as a matrix, together with the R-Y and B-Y chrominance signals. The chrominance signals are also delayed to match the delay through the sparkle reduction circuit. Sparkle reduction processing of the luminance signal has been found to reduce the sparkle problem by about 60% to 70%.

The outputs of the color space converter are video drive signals, for example, R G B, supplied to the LCOS imager. In another embodiment, one or two or all of the video drive signals are also subjected to the same sparkle reduction processing as is the luminance signal. Video drive signals that are not sparkle reduced must be delay matched. The modified video drive signals are then supplied to the liquid crystal imager. When all of the video drive signals are further processed, the sparkle problem has been found to be reduced by about 85% to 90%. Each decomposer advantageously has an independently selectable brightness level threshold.

In yet another embodiment, the luminance signal is not sparkle reduced, but one or two or all of the video drive signals are processed for sparkle reduction. Video drive signals that are not sparkle reduced must be delay matched.

In each embodiment, the sparkle reduction processing changes the brightness levels of the pixels in the lowest brightness levels, corresponding to the highest gain portion of the gamma table, in such a way as to reduce the occurrence of disclination in the LCOS imager. A threshold for the luminance signal decomposer, for example, can be expressed as a digital fraction, for example a digital value of 60 out of a range of 255 digital steps ($^{60}/_{255}$), as would be present in an 8-bit signal. The threshold can also be expressed in IRE, which ranges from 0 to 100 in value, 100 IRE representing maximum brightness. The IRE level can be calculated by multiplying the digital fraction by 100. The IRE scale is a convenient way to normalize and compare brightness levels between signals having different numbers of bits. The value of 60, for example, corresponds approximately to 24 IRE. In a presently preferred embodiment, the threshold value for the luminance decomposer is 8, corresponding to approximately 3.1 IRE.

DETAILED DESCRIPTION OF THE PREFERRED EMBODIMENTS

Figure 1:
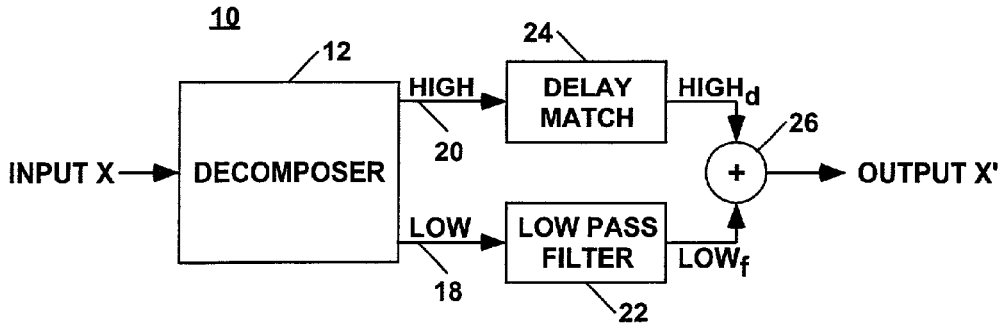
FIG. 1 is a block diagram of a sparkle reducing circuit in accordance with the inventive arrangements.

A circuit for reducing sparkle artifacts attributed to disclination errors in liquid crystal video systems, for example LCOS video systems, is shown in FIG. 1 and generally denoted by reference numeral 10, The circuit comprises a decomposer 12, a slew rate limiter 22, a delay match circuit 24 and an algebraic unit 26. An input video signal X, for example a luminance signal or a video drive signal, is modified by the circuit 10, and in response, an output video signal X' is generated. The video signal is a digital signal, and the waveform is a succession of digital samples representing brightness levels. The output signal X' has a similar digital format. The decomposer 12 generates a higher brightness level signal 20 and a lower brightness level signal 18. The operation of decomposer 12 is illustrated in FIG. 2.

Figure 2:
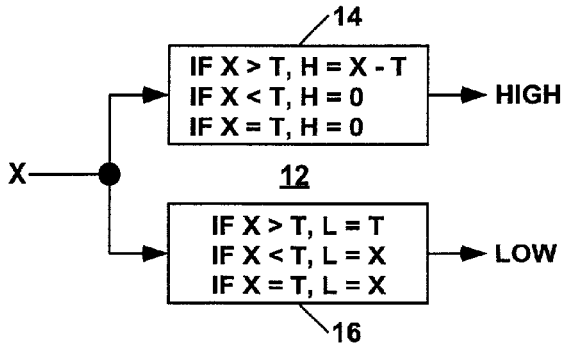
FIG. 2 is a block diagram useful for explaining the operation of a decomposer in FIG. 1.

With reference to FIG. 2, a block 14 has a first set of rules for generating the higher brightness level signal. The input signal X represents a succession of brightness level samples defining a luminance input signal. The brightness level of each sample can be expressed numerically as a digital value or an IRE level, for example $^{60}/_{255}$ or 24 IRE, as explained above. The letter T represents a threshold value, which can also be expressed as a digital value or an IRE level. If x is greater than T, then the brightness level H of the higher brightness level signal is equal to X minus T. If X is less than T, then the brightness level H of the higher brightness level signal is equal to 0.

A block 16 has a second set of rules for generating the lower brightness level signal. If X is greater than T, then the brightness level L of the lower brightness level signal is equal to the threshold T. If X is less than T, then the brightness level L of the lower brightness level signal is equal to X.

It may be noted that when X=T, the output of block 14 will be the same whether X is defined as less than or equal to T, or X is defined as greater than or equal to T. In each case, H is equal to 0. It may also be noted that when X=T, the output of block 16 will be the same whether X is defined as less than or equal to T, or X is defined as greater than or equal to T. In each case, L is equal to X.

Figure 3:
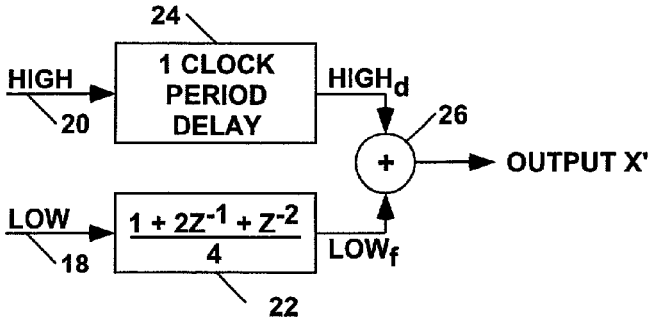
FIG. 3 is a block diagram useful for explaining the operation of a delay matching circuit and a low pass filter in FIG. 1.

Referring again to FIG. 1, the lower brightness level signal 18 is an input to the low pass filter 22. The higher brightness level signal 20 is an input to the delay match circuit 24. The details of the low pass filter 22 and the delay match circuit 24 are shown in FIG. 3. Low pass filter 22 is embodied as a normalized 1:2:1 Z-transform. The low pass filtering incurs a one clock period delay, and accordingly, the delay match circuit 24 provides a one clock period delay for the higher brightness level signal. The low pass filtered lower brightness level signal, denoted $LOW_f$, and the delayed higher brightness level signal denoted $HIGH_d$ are combined in an algebraic unit 26, which generates the output signal X'.

Figure 4:
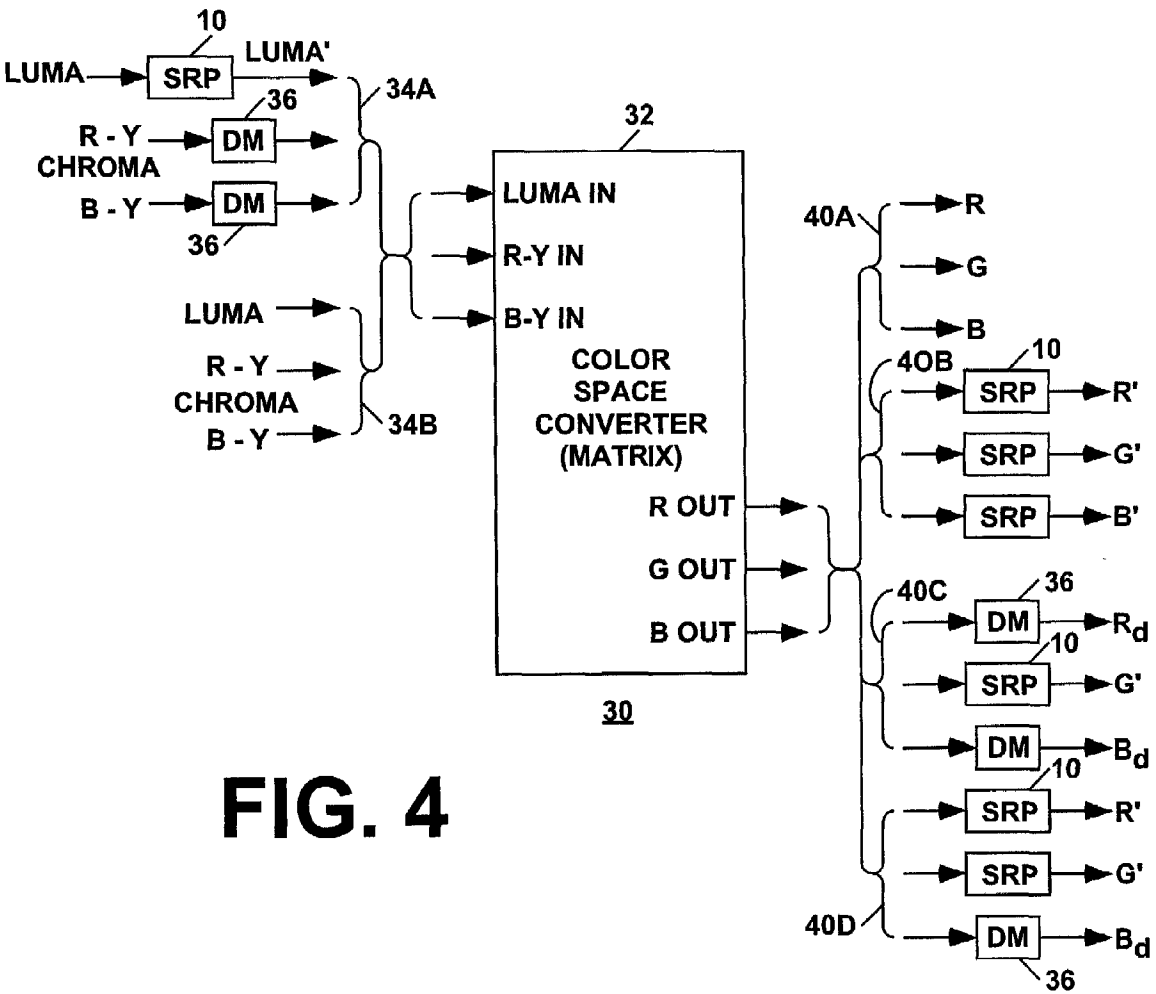
FIG. 4 is a block diagram of a portion of a video display system incorporating different combinations of sparkle reducing circuits.
Figure 5A:
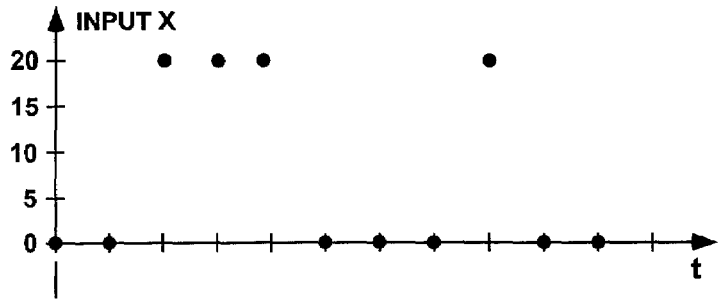
FIGS. 5(*a*)–5(*e*) are waveforms useful for explaining the operation of the sparkle reducing circuit.
Figure 5B:
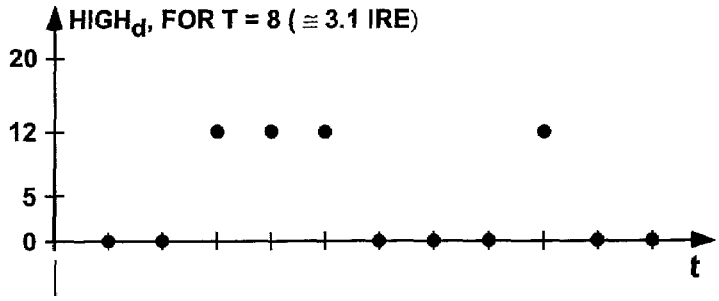
Figure 5C:
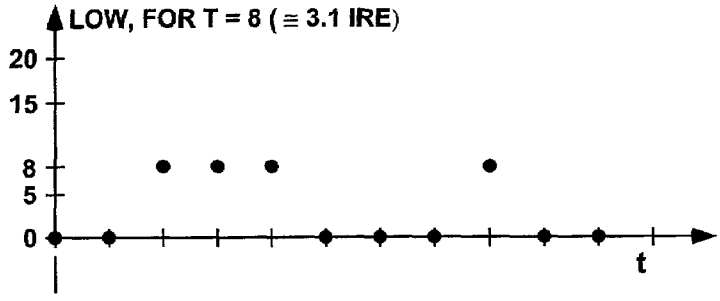
Figure 5D:
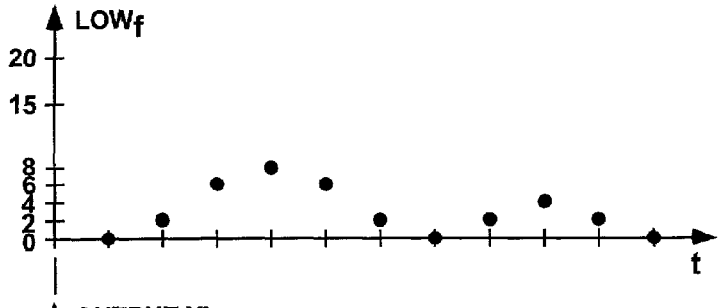
Figure 5E:
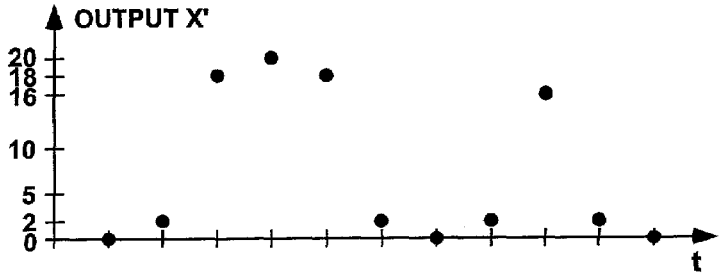

A video system 30 shown in FIG. 4 illustrates various combinations in which video signals, for example luminance signals and video drive signals, can be processed for sparkle reduction. A color space converter, or matrix, 32 generates video drive signals, for example RGB, responsive to a luminance signal, denoted LUMA, and chrominance signals, denoted CHROMA. The chrominance signals are more particularly designated R-Y and B-Y.

Two sets of inputs to the color space converter 32 are denoted 34A and 34B. In set 34A the LUMA signal input is modified by sparkle reduction processor (SRP) 10 to generate LUMA'. The CHROMA signals are delayed by delay match (DM) circuits 36. In set 34B the LUMA signal is not modified and the CHROMA signals are not delay matched.

Four sets of outputs from the color space converter 32 are denoted 40A, 40B, 40C and 40D. In set 40A the video drive signals RGB are not modified. In set 40B, each one of the RGB video drive signals is modified by a sparkle reduction processor 10. No delay matching is necessary. In set 40C only one of the video drive signals, for example G, is modified by sparkle reduction processor 10 to generate G'. The remaining video drive signals are delayed by delay matching circuits 36. In set 40D only two of the video drive signals, for example R and G, are modified by sparkle reduction processors 10 to generate R' and G'. The remaining video drive signal is delayed by delay matching circuit 36. Input set 34A can be used with any one of output sets 40A, 40B, 40C or 40D. Input set 34B can be used with any one of output sets 40B, 40C or 40D. The combination of input set 34B and output set 40A does not include sparkle reduction processing.

It has been found that using the combination of input set 34A and output set 40A can significantly reduce the sparkle artifact attributed to disclination. It has also been found that using the combination of set 34A and output set 40B can reduce the sparkle attributed to disclination even further. This substantial reduction advantageously solves the the sparkle problem for all practical purposes. It should be appreciated that although the sparkle reduction processing circuits in FIG. 4 can be identical to one another, the threshold value and the slew rate limits for each of these sparkle reduction processing circuits can advantageously be independently selected. This enables the sparkle reduction processing to be fine-tuned to the different video signals.

The response of circuit 10 in FIG. 1 to a specific input signal is illustrated in FIGS. 5(*a*) through 5(*e*). For purposes of illustration, the threshold T is set to the digital value or state of 8, corresponding to approximately 3.1 IRE for an 8-bit signal. The waveforms of FIGS. 5(*a*)–5(*e*) are aligned in time to demonstrate the delay incurred by the low pass filtering and the delay match circuit. The first samples in each of FIGS. 5(*a*) and 5(*c*) are aligned with one another. The first samples of FIGS. 5(*b*), 5(*d*) and 5(*f*) are aligned with one another.

In FIG. 5(*a*) an input signal X has the luminance values shown by the black dots. Each black dot represents a sample of a luminance value as an input to the decomposer 12. Each sample represents the brightness level of a pixel. The signal X can be seen as including a pulse followed by an impulse. The threshold value of T, as explained in connection with the rules of FIG. 2, is equal to 8 in this example.

The first two values of X are 0. In accordance with block 14, the value of the delay matched higher brightness level signal HIGHd shown in FIG. 5(*b*) is 0 because X is less than T. The next three input values are 20. The corresponding levels of the higher brightness level signal in FIG. 5(*b*) are 12 because the output value equals the input value minus the threshold value (X-T). The remaining sample values are calculated in the same fashion.

With reference to FIG. 5(*c*), the first two output values of the lower brightness level signal LOW are 0, because the input is less than the threshold and the output equals the input. The next three output values are equal to 8 because the input value is greater than that threshold, and in this case, the output equals the threshold value. The remaining samples are calculated in the same fashion.

FIG. 5(*d*) represents the output $LOW_f$ of low pass filter 22 responsive to the signal shown in FIG. 5(*c*). The values are shown as indicated, and it can be noted that the pulse and impulse which are still evident in the wave form of FIG. 5(*c*) have been considerably smoothed, or rolled off, by the low pass filtering.

Finally, FIG. 5(*e*) is the output signal X', which is the sum of the wave forms in FIGS. 5(*b*) and 5(*d*). It can be noted from the wave form in FIG. 5(*e*) that the essential character of the pulse and of the impulse in the input wave form X been retained in the output wave form X, but sharp edges or transitions between adjacent sample values have been advantageously reduced. Only the very dark areas of the picture are noticeably affected by the sparkle reduction processing, as evidenced by the very low value of the threshold limit. Accordingly, the high definition horizontal resolution is advantageously maintained.

The methods and apparatus illustrated herein teach how the brightness levels of adjacent pixels can be restricted or limited in the horizontal direction, and indeed, these methods and apparatus solve the sparkle problem. Nevertheless, these methods and apparatus can also be extended to restricting or limiting brightness levels of adjacent pixels in the vertical direction, or in both the horizontal and vertical directions.

What is claimed is:

1. A method for reducing sparkle artifacts of a liquid crystal imager, comprising the steps of:

dividing a video signal for a picture into a higher brightness level signal and a lower brightness level signal low pass filtering said lower brightness level signal;

delaying said higher brightness level signal to match a processing delay incurred by said low pass filtering; and, combining said low pass filtered lower brightness level signal, and said delay matched higher brightness level signal;

applying said combined video signal to said imager thereby reducing effects of orthogonal fields in adjacent pixels of said imager.

2. The method of claim 1, comprising the step of dividing said video signal in accordance with a transition between lower and higher gain portions of a gamma table associated with said imager.

3. The method of claim 1, wherein said dividing step comprises the steps of:

selecting a brightness level threshold;

comparing successive input brightness levels of said video signal to said selected threshold;

for each said input brightness level greater than said threshold in said comparing step, assigning to said higher brightness level signal a brightness level equal to a difference between said greater input brightness level and said threshold and assigning to said lower brightness level signal a brightness level equal to said threshold; and, for each said input brightness level less than said threshold in said comparing step, assigning to said higher brightness level signal a brightness level equal to zero and assigning to said lower brightness level signal a brightness level equal to said input brightness level.

4. The method of claim 3, comprising the steps of:

assigning to said higher brightness level signal a brightness level equal to zero if said input brightness level is equal to said threshold; and, assigning to said lower brightness level signal a brightness level equal to said input brightness level if said input brightness level is equal to said threshold.

5. The method of claim 1, comprising the step of low pass filtering said lower brightness level signal in accordance with a normalized 1:2:1 Z-transform, said lower brightness level signal being thereby subjected to a time delay.

6. The method of claim 5, comprising the step of delaying said higher brightness level signal by said time delay.

7. The method of claim 1, comprising the steps of:

applying said sparkle reducing steps to a luminance signal for said picture;

delaying chrominance signals for said picture; and, generating a plurality of video drive signals from said modified luminance signal and said delayed chrominance signals.

8. The method of claim 7, comprising the steps of:

applying said sparkle reducing steps to at least one of said video drive signals; and, delaying all non-sparkle-reduced video drive signals.

9. The method of claim 1, comprising the steps of:

generating a plurality of video drive signals from luminance and chrominance signals;

applying said sparkle reducing steps to at least one of said video drive signals; and, delaying all non-sparkle-reduced video drive signals.

10. The method of claim 7, comprising the step of applying said sparkle reducing steps to each of said video drive signals.

11. A circuit for reducing sparkle artifacts in a liquid crystal imager, comprising:

means for dividing a video signal for a picture into a higher brightness level signal and a lower brightness level signal;

means for low pass filtering said lower brightness level signal;

means for delaying said higher brightness level signal to match a processing delay incurred by said low pass filtering; and, means for combining said low pass filtered lower brightness level signal and said delay matched higher brightness level signal to generate a modified video signal yielding reduced sparkle artifacts in said imager.

12. The circuit of claim 11, wherein said dividing means comprises:

a register for storing a selected threshold value;

a comparator for comparing successive input brightness levels of said video signal to said selected threshold value;

an algebraic circuit for subtracting said threshold value from every one of said input brightness levels greater than said threshold;

a clipping circuit for limiting to said threshold value every one of said input brightness levels greater than said threshold value;

a first gate for propagating a zero value brightness level for every one of said input brightness levels less than said threshold value;

a second gate for propagating said input brightness level for every one of said input brightness levels less than said threshold; and, said higher brightness signal is formed by outputs from said algebraic circuit and said first gate and said lower brightness level signal is formed by outputs from said clipping circuit and said second gate.

13. The circuit of claim 12, wherein:

said higher brightness level signal is formed by said output of said first gate when said input brightness level is equal to said threshold value; and, said lower brightness level signal is formed by said output of said second gate when said input brightness level is equal to said threshold value.

14. The circuit of claim 11, wherein said threshold value relates to a transition between lower and higher gain portions of a gamma table associated with said imager.

15. The circuit of claim 11, wherein said means for low pass filtering applies a normalized 1:2:1 Z-transform to said lower brightness level signal, said lower brightness level signal being thereby subjected to a time delay.

16. The circuit of claim 15, wherein said higher brightness level signal is delayed by said time delay.

17. The circuit of claim 11, further comprising:

means for delaying chrominance signals for said picture; and, means for generating a plurality of video drive signals from a modified luminance signal and said delayed chrominance signals.

18. The circuit of claim 17, comprising the steps of:

means for dividing at least one of said video drive signals into a higher brightness level video drive signal and a lower brightness level video drive signal;

means for low pass filtering said lower brightness level video drive signal;

means for delaying said higher brightness level video drive signal to match a processing delay incurred by said low pass filtering; and, means for combining said low pass filtered lower brightness level video drive signal and said delay matched higher brightness level video drive signal to generate a modified video drive signal resulting in a further reduction of disclination in said imager.

19. The circuit of claim 18, wherein said brightness level thresholds for said luminance signal dividing means and said video drive signal dividing means are independently selectable.

20. The circuit of claim 18, comprising:

respective means for dividing, low pass filtering, delaying and combining each one of said video drive signals; and, each of said luminance signal dividing means and said video drive signal dividing means having independently selectable brightness level thresholds, each of said luminance signal dividing means and said video drive signal dividing means having independently selectable brightness level thresholds.

21. A circuit for reducing sparkle artifacts in a liquid crystal images, comprising:

a decomposer for dividing a video signal for a picture into a higher brightness level signal and a lower brightness level signal;

a low pass filter for processing said lower brightness level signal, said low pass filtered lower brightness level signal being delayed;

a delay circuit for said higher brightness level signal matched to said processing delay in said low pass filter; and, an algebraic circuit for combining said low pass filtered lower brightness level signal and said delay matched higher brightness level signal, and generating a modified video signal yielding reduced sparkle artifacts in said images.

22. The circuit of claim 21, wherein said decomposer has a selectable threshold value.

23. The circuit of claim 22, wherein said threshold value is related to a transition between lower and higher gain portions of a gamma table associated with said images.

24. The circuit of claim 21, wherein said low pass filter applies a normalized 1:2:1 Z-transform to said lower brightness level signal, said lower brightness level signal being thereby subjected to a time delay.

25. The circuit of claim 24, wherein said higher brightness level signal is delayed by said time delay.

* * * * *

UNITED STATES PATENT AND TRADEMARK OFFICE

CERTIFICATE OF CORRECTION

PATENT NO. : 7,119,774 B2
APPLICATION NO. : 09/803485
DATED : October 10, 2006
INVENTOR(S) : Donald Henry Willis and John Alan Hague It is certified that error appears in the above-identified patent and that said Letters Patent is hereby corrected as shown below:

On the Title Page, Item (56) under the heading "FOREIGN PATENT DOCUMENTS", please insert the following:

--EP 0751682 8/2003
WO 00/10326 2/2000--

Signed and Sealed this

Twenty-first Day of August, 2007

JON W. DUDAS
*Director of the United States Patent and Trademark Office*